United States Patent [19]

Carr

[11] Patent Number: 4,815,996

[45] Date of Patent: Mar. 28, 1989

[54] MARINE PROPULSION AND CONTROL ARRANGEMENT

[75] Inventor: Harold B. Carr, Unit 9, 21 Sparks Road, Henderson, State of Western Australia, 6166, Australia

[73] Assignees: Harold Brian Carr; Arnold Stephen Lundy, both of Cunderdin, Australia

[21] Appl. No.: 590,524

[22] Filed: Mar. 16, 1984

[30] Foreign Application Priority Data

Mar. 16, 1983 [AU] Australia ..... PF8476
Mar. 16, 1983 [AU] Australia ..... PF8475

[51] Int. Cl.[4] ..... B63H 5/12

[52] U.S. Cl. ..... 440/75; 440/80; 440/83; 440/53

[58] Field of Search ..... 440/53, 54, 75, 80, 440/86; 114/144 R, 144 E, 147, 150; 74/459.5

[56] References Cited

U.S. PATENT DOCUMENTS

| | | | |
|---|---|---|---|
| 1,694,027 | 12/1928 | Wildhaber | 74/459.5 |
| 2,369,456 | 2/1945 | Hammond | 114/147 |
| 2,936,730 | 5/1960 | Patty | 440/75 |
| 3,113,549 | 12/1963 | Frank et al. | 440/75 |
| 3,888,203 | 6/1975 | Lohse | 440/75 |
| 3,976,023 | 8/1976 | Noguchi et al. | 114/144 E |
| 4,271,780 | 6/1981 | Etoh | 114/144 E |
| 4,334,489 | 6/1982 | Seitzinger et al. | 114/150 |
| 4,382,797 | 5/1983 | Blanchard | 440/75 |

*Primary Examiner*—Sherman O. Basinger
*Assistant Examiner*—Stephen P. Avila
*Attorney, Agent, or Firm*—Cushman, Darby & Cushman

[57] ABSTRACT

A marine propulsion unit providing for steerable legs for the propeller of a boat which are rotatable in steering direction through 360°. A transmission is provided having spiral bevel gears arranged so that for a constant direction of rotation bearing, loading for parts below the hull can be significantly reduced. There are provided two separate legs having a common drive each being rotatable in steering direction through 360° so that reverse thrust can be achieved without changing the rotating direction of the thrusting propellers relative to their support.

11 Claims, 3 Drawing Sheets

MARINE PROPULSION AND CONTROL ARRANGEMENT

This invention relates to a marine propulsion drive arrangement and to a gear arrangement for such propulsion.

It is known to use two drive propulsion propellers separately driven but joined together by a mechanical interlink for steering purposes.

In order to propel a boat in the reverse direction with such an arrangement, it is conventional to change the directional drive of the propellers so that these rotate in a reverse direction.

In practice this normally requires a gear box with means to disengage the drive connection to the propellers and to then interconnect a further gear element to cause the propellers to be driven in an opposite rotational direction about their axis.

Mechanical devices of this type have been found to be extremely vulnerable to break down especially when being used by persons such as fishermen working consistently to locate a boat for holding or controlling a net or holding or controlling fishing lines and so on.

Costs associated with replacement of such gear boxes have been found to be extremely high and can involve a lay-up of a boat for a significant period of time all of which is extremely expensive.

The simple solution to this might be said to provide that there is a single propeller supported by a leg which can be rotated for a propulsion direction through 360°.

While the use of a single leg might be of some value in holding a boat in a fixed position relative to some reference location, to use such an arrangement for a main propulsion is a difficulty of another order.

The problem is in fact that in the first instance, to obtain a reverse thrust by pointing the propeller from a rearward pointing direction to a forward pointing direction means that there is an appreciable time while the propeller is facing in other directions and unless the propeller is disconnected during this period, which then involves the previously indicated problem of connecting clutches and gear boxes, the boat is badly skewed during such a reversal manoeuvre.

This would have to be totally unacceptable in so many practical situations that using a rearwardly pointing propeller would seem to be superficially not a sensible approach.

We have solved this problem by providing that there are two propellers, both symmetrically located with respect to the boat and connected to the same driving means so that if the boat is to be given a reverse thrust, it can be achieved by causing each of the propellers to turn through in their thrusting pointing direction 180° but so that the two propellers will proceed to this direction by one proceeding counter-clockwise and the other clockwise.

In this way, any skewing thrust will be counteracted provided of course the effective rotational speed and propulsion thrust achieved by each propeller is substantially the same and in this way therefore the significant advantages of having such separable steerable propellers can be achieved.

There is yet another problem however.

While there may be various ways by which rotation of the propeller can be effected from an on-board drive means, the overwhelmingly most sensible approach is to provide three shafts connected through spiral bevel gears, a second of the shafts passing through the hull of the boat and the third shaft having at one end the propeller.

An aspect of this invention is that it has specific application to larger rather than smaller boats and it becomes therefore a problem that there can be very large forces exerted upon components effecting a transfer of driving torque to a propeller with subsequent high loading on bearings and coupled with this either an exceedingly high cost in terms of bearings or a relatively short life with respect to bearings.

While in some locations, the life of a bearing is not a major cost with respect to maintenance of the equipment, a bearing located in a leg depending below the hull on a large boat is generally not accessible unless the boat is slipped.

Further, it is not always convenient to slip a boat or indeed find that a bearing has gone beyond an acceptable wear limit when the boat is in the middle of the ocean.

It is in relation to this problem that a major discovery has been made which has finally provided that the concept of steerable legs for marine propulsion can become a practical reality.

To understand the further point of the invention, a feature regarding spiral bevel gears must be clarified.

This is that when a spiral bevel gear is mated with a corresponding spiral bevel gear, in one direction of rotation it is found that there is a very significant thrust between mating gears which transmits itself to the shafts and it is therefore essential that the shafts are supported by bearings having high loading capacities.

If the spiral gears are mutually rotated in an opposite direction to the above direction, it is found that there is a joining or clawing together.

Accordingly, so long as the direction of rotation is in one direction only and not in both directions, we have found that by appropriately arranging the handedness of respective spiral bevel gears, the loading on critical bearings within a propulsion leg can be reduced from something approaching 1,000 pounds to something less than 10 pounds.

By providing that all of the bearings at least those below the water line and only accessible generally by slipping of the boat are run with such significantly low bearing loads, this can ensure an extremely long life and makes it extraordinarily practical to provide for such a steering arrangement for boats.

Accordingly, we have discovered that by appropriate arrangement of spiral bevel gears, a steerable marine propulsion leg can be made that it will last for a very long time without routine maintenance, but combining this with counter-rotational direction of two symmetrically located propulsion drive members has meant that there is now an arrangement by which a very effective marine propulsion system can be achieved.

Such an arrangement providing for very significantly reduced bearing loads and therefore very extended maintenance periods is useful in relation to the application only where the direction of rotation of the bevel gears is consistent and of course in the appropriate direction rather than the opposite direction.

By use of bevel gears in such an arrangement which are so arranged and having these in an arrangement where there are two legs each supporting a propeller so that a reverse thrust can be achieved without causing undue skewing of the boat by having the steering direction of each of the propellers changed in a direction of opposite hand, the effect of one propeller therefore cancelling out the effect of the other while partly through the rotation.

The invention accordingly can be said to reside in a boat propulsion unit including drive means to effect rotation of a propeller including two bevelled gears secured for common coaxial rotation with a second shaft, each of the bevel gears being affixed to the second shaft so as to be facing in an opposite direction one with respect to the other when considered along the axial direction of the said second shaft, and each bevel gear intermeshing with a correspondingly positioned and shaped bevel gear attached in a first instance to a first shaft which is aligned transversely to the axis of the said second shaft, and in the second instance to a third shaft adapted to have a propeller secured thereto which shaft is aligned transversely to the axis of the said second shaft the unit being characterised in that each said gear is a spiral bevel gear, and the direction of the spiral in the case of this said two gears affixed to the said second shaft is of the same hand that is they are either both left hand spiral bevel gears or are both right hand spiral bevel gears.

Preferably the said third shaft has a boat propulsion propeller secured at an outer end thereof.

Preferably the two said spiral bevel gears secured to the said second shaft are facing so that each is facing away from the facing direction of the other and accordingly, the connection between the first shaft, the second shaft and the third shaft, is such that a thrust effective upon rotation of the first shaft in a first selected direction will be countered by a substantially equivalent thrust in the opposite direction along the second shaft effect by reason of the engagement between the respective spiral bevel gears meshing between the said second shaft and the said third shaft.

Preferably the invention can reside in a boat propulsion unit as above when installed within a boat so that the said second shaft together with a supporting housing projects through a lowermost hull portion of the boat.

Preferably there are two such boat propulsion units combined with a boat each located so as to have its second shaft together with the appropriate supporting housing projecting through a lowermost portion of a hull of a boat each of the units being located equidistant from the centre line of the boat but to opposite sides of such centre line.

Preferably each of the propulsion units so located within a boat is driven by the same drive motor.

The invention will now be described with the assistance of drawings.

For a better understanding of this invention it will now be described with reference to drawings wherein FIG. 1 is a schematic view of a support arrangement for two boat propulsion drive propellers and supporting housings and drive coupled in a manner to show how these are joined to the same drive motor;

FIG. 2 illustrates a control panel arrangement;

FIGS. 3, 4, 5 and 6 are schematic plan views of a typical arrangement showing propulsion direction control centre and the arrangements by which the two driving propellers can be orientated to effect a reversal of thrust without resultant side-way movement or as in the case in FIG. 5, dual steering direction for side-ways movement if required, and FIG. 7 is a cross-sectional view of a propulsion unit according to the preferred embodiment.

Referring in detail to the drawings and in particular to FIG. 1, this is simply a schematic drawing showing two spaced apart boat propulsion units which when incorporated within a boat will be located on opposite sides of but equidistant from a rear end of the boat.

Each assembly 1 is identical so that by being driven by a common drive motor 2 through equivalent assemblies 3 and 4 results in pulleys 5 and 6, rotating propellers 7 and 8 with the same rotational speed and, therefore, thrust.

Control of the propulsion direction of each of the propellers 7 and 8 is such that each of the propellers can be independently turned so as to be able to be directed through any direction or put in another way each propeller can be rotated for propulsion direction through 360°.

FIG. 2 illustrates the control centre in a boat by which two such assemblies as in FIG. 7 are controlled.

There is a control arrangement between each propulsion unit and a toggle at 22 for port control and the starboard control at 23.

Located with a display 24 are display means comprising a plurality of light emitting diodes indicating by being appropriately lit, the actual pointing direction of the respective propeller.

The displays 25 or 26 are thereby position indicators showing a resultant heading as set by the appropriate control member either 22 in the case of the port control or 23 in the case of the starboard control each of these being a three position toggle electric switch effecting a selected rotation direction of steering motor.

It is a feature of the arrangement described that each control member 22 and 23 independently and separately control only the respective headings that is direction of thrust of the propellers located in the case of the control member 22 the propeller on the port side of the boat, and in the case of the starboard control that is 23 the propeller on the starboard side of the boat.

FIGS. 3, 4, 5 and 6 are schematic views from above a boat illustrating a boat 27 and two propeller direction control and driving assemblies 28 and 29 each including a propeller 30 and 31 respectively.

The propulsion rotation of each of the propellers 30 and 31 is effected by motor 32 driving through in this case a belt drive 33 and 34 the gear assemblies within the units 28 and 29.

The direction of each of the propellers in terms of its propulsion driving direction is controlled from a control centre 35 which includes independent control members 36 controlling the direction of drive of propeller 30 and control member 37 which controls the direction of propulsion of propeller 31.

By use of the several control members 36 and 37 the direction of propulsion thrust of each of the propellers can be effected so as to turn in an opposite hand direction so as to reach the position as shown in FIG. 3 and then of course pass from this to be fully forwardly pointing so as to effect a rearward motion of the boat.

By having indentical assemblies for connecting each propeller to a drive source and having a common engine, and having each of the propellers located equidistant from a centre line of the boat that is a central line passing from the bow to the rear of the boat ensures that there is equivalent thrust effected with respect to each propeller so that when these are turned in a contra hand direction there will be no or at least substantially minimal side thrust effected with respect to the boat and the effect then will be simply to slow the thrust in a forward direction and eventually increase this in a rearward direction on the boat.

Figure 1:
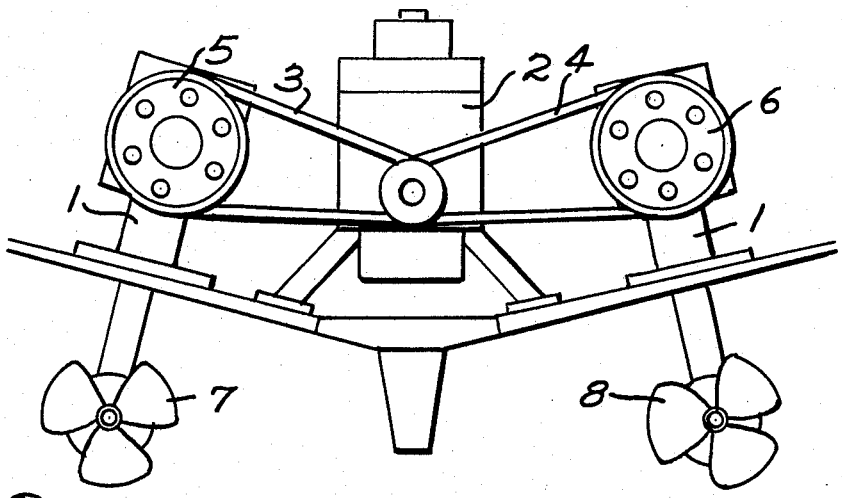
Figure 2:
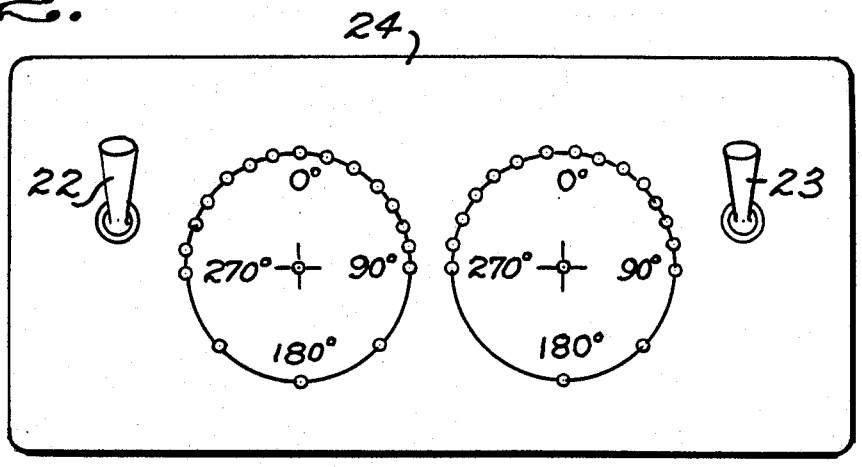
Figure 3:
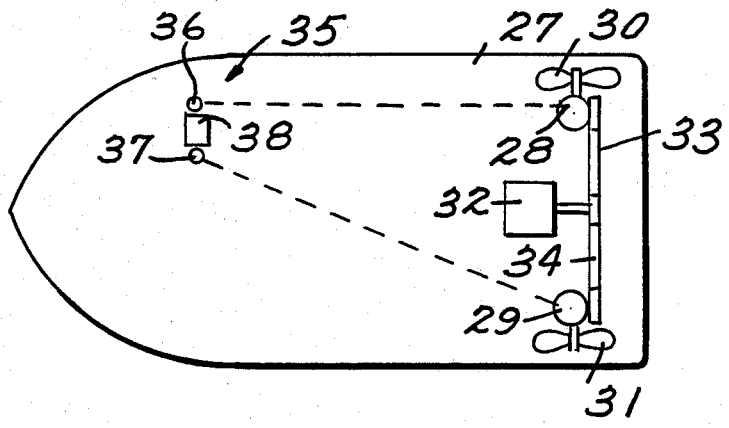
Figure 4:
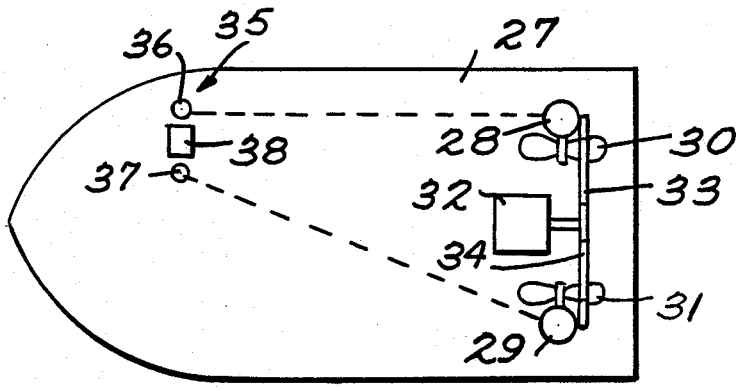
FIG. 4 shows the alternate contra hand direction position so that the propellers can be inwardly turned to go from forward to reverse propulsion direction.
Figure 5:
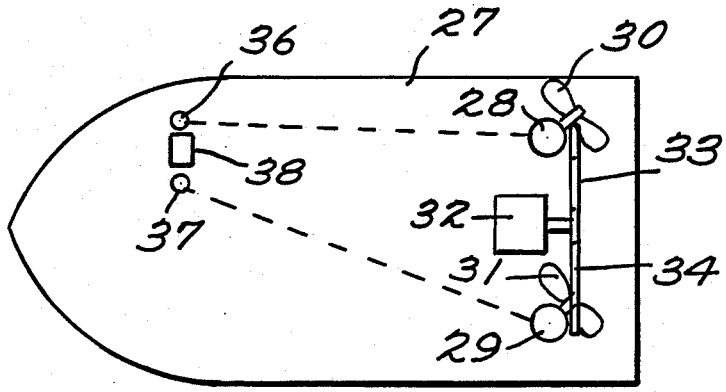
FIG. 5 shows how the propellers are used for simple steering direction and can be operated jointly in a common direction if required.
Figure 6:
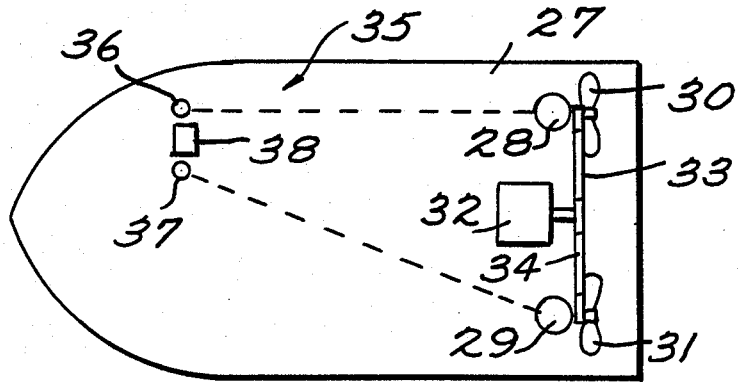

Referring to FIG. 6, this illustrates the position of the propellers for a dead ahead setting conventional drive.

Figure 7:
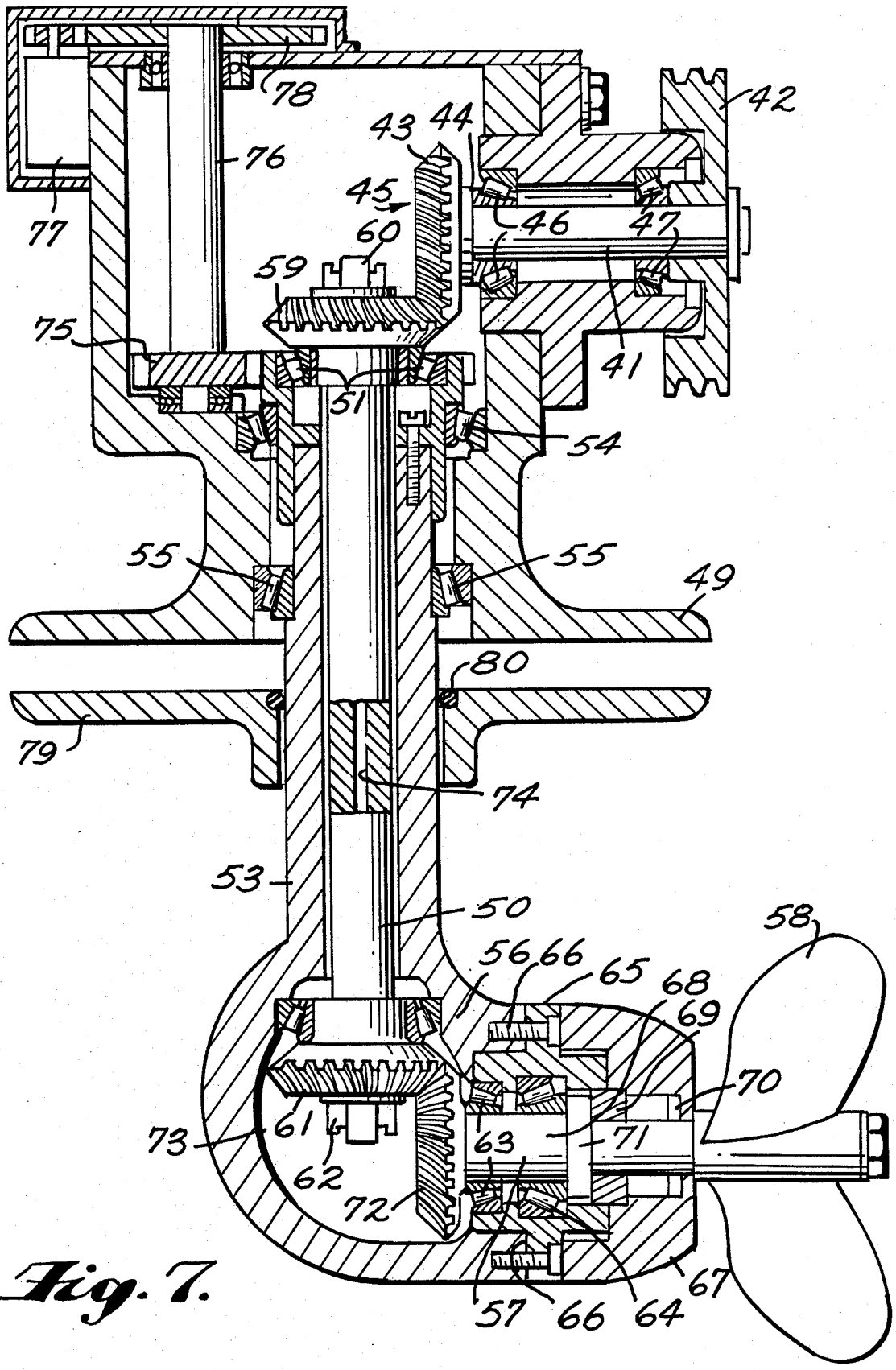

Now referring in detail to FIG. 7, there is a first shaft 41 which has secured at one end a V belt pulley 42 and at the other end a spiral bevel gear 43.

The intended direction of rotation is seen by reference to arrow 44.

Bevel gear 43 is herein referred to as a right handed gear that is when its face is viewed in the direction 45 the curvature of the teeth is such that they curve toward a clockwise direction as they extend outwardly. The first shaft is supported by two sets of in-thrust bearings 46 and 47 which is generally supported by a body 48 which is secured through flange 49 to a lowermost hull portion of a boat which is not specifically shown.

A second shaft 50 is supported by in-thrust bearings 51 and 52 with respect to a rotatable housing 53 the rotatable housing 53 being supported for rotation about the axis of the second shaft 50 by means of in-thrust bearings 54 and 55.

The housing 53 includes a lowermost bulbous portion 56 which further supports a third shaft 57 to which propeller 58 is secured.

The second shaft 50 has secured at an upper end thereof a left handed spiral bevel 59 which is secured thereto by castellated nut 60.

A lower end of the second shaft 50 has secured thereto a left handed spiral bevel 61 this also being affixed by castellated nut 62.

Supported within the housing 56 the third shaft 57 is rotatably secured therein by in-thrust bearings 63 and 64.

There is a bearing assembly holder 65 held by bolts 66 and there is an end cap 67 which screwably engages the assembly 65 at 68 and holds an oil seal 69 and a water seal 70 in engagement with the shaft 57. The shaft 57 is held by screw engagement of ring 71. At a forward end of the third shaft 57 is a right handed spiral bevel gear 72.

Oil access into the cavity 73 is achieved through an axially central conduit 74 passing through the second shaft 50.

A thrusting direction of the propeller 58 depends on the relative rotation of housing 53 with respect to the body 48.

This is controlled through gear 74 meshing with gear member 75 supported at the lowermost end of steering control shaft 76 the relative rotational position of which is governed by motor 77 which is a direct current electric motor which meshes with gear 78 which is affixed to steering control shaft 76.

Flange 79 provides a water seal 80 with respect to the outer surface of the housing 53 and the respective flanges 49 and 79 are adapted to secure about a lowermost position of the hull of a boat so as to provide strong securement thereto and a water tight seal. As has been previously described, by using spiral bevel gears in the arrangement shown, there is in the first instance provided a counteracting thrust so that particularly bearings 51 and 52 will be very lightly loaded and as compared to an arrangement in which the spiral direction is opposite on only one of the bevel gears, on calculations in one instance it is found that there is a tenfold increase in loading pressure.

It is an additional feature that the pressures applicable along the alignment of the third shaft can likewise to a large extent be reduced where the propulsion thrust of the propeller 58 is countered at least to some extent by the opposite thrust effected by the drive connection with respect to the bevel gears 61 and 72.

It is acknowledged that such a counteracting forces is not available with respect to the first shaft but it is also noted that access to this shaft and to the bearings therein is easily achieved during routine maintenance and the problems discussed previously are not directly applicable to the location of the first shaft.

It will now be appreciated that there is significant advantage in using such an arrangement specifically where the direction of rotation of the drive shaft and particularly the propeller will stay the same.

I claim:

1. A boat propulsion drive means to effect rotation of a propeller including two bevelled gears secured for common coaxial rotation with a second shaft, each of the bevel gears being affixed to the second shaft so as to be facing in an opposite direction one with respect to the other when considered along the axial direction of the said second shaft, and each bevel gear intermeshing with a correspondingly positioned and shaped bevel gear attached in a first instance to a first shaft which is aligned transversely to the axis of the said second shaft, and in the second instance to a third shaft adapted to have said propeller secured thereto which shaft is aligned transversely to the axis of the said second shaft, the drive means being characterised in that each said gear is a spiral bevel gear, and the direction of the spiral in the case of the said two gears affixed to the said second shaft is of the same hand so that they are either both left hand spiral bevel gears or are both right hand spiral bevel gears.

2. A boat propulsion unit as in claim 1 further characterised in that each said shaft is supported with respect to a housing, the housing being rotatable about the axis of the said second shaft.

3. A boat propulsion unit as in claim 1 further characterised in that each of the spiral bevel gears is of the same pitch and the same diameter.

4. A boat propulsion unit as in claim 1 wherein the two said spiral bevel gears secured to the said second shaft are facing so that each is facing away from the direction of the other, and accordingly, the connection between the first shaft, the second shaft and the third shaft, is such that a thrust effective upon rotation of the first shaft in a first selected direction will be countered by a substantially equivalent thrust in the opposite direction along the second shaft effected by reason of the engagement between the respective spiral bevel gears meshing between the said second shaft and the said third shaft.

5. A boat propulsion unit according to claim 4 in which the pitch of the propeller is such as to effect when rotated through the water a force significantly countering the end thrust otherwise effected by rotation between the respective spiral bevel gears between the said second shaft and the said third shaft.

6. A boat including a propulsion unit as in claim 1, there being two drive means arranged to effect a propelling rotation of two propulsion propellers each secured to a respective third shaft steerable in a propelling direction through 360° of rotation about an upright axis, each propeller supported in a spaced apart relationship with respect to the other propeller and positioned and connected to said driving means and motor or motors and otherwise adapted so as to provide at least a substantially equal driving thrust.

7. A boat as in claim 6 further characterised in that each driving propeller is located on an opposite side of but equidistant from a center line of the boat, and each propeller is equidistant from a rear end of the boat when positioned to have a common propulsion direction with respect to the other propeller.

8. A boat as in either of claim 6 including control centre which includes a visual display, and means interconnecting each control member with the visual display such that there will be displayed a display indicating the propulsion direction for each respective propeller.

9. A boat according to claim 6 further characterised in that each of the two propellers is of the same diameter and has the same pitch and is drivably connected the same by engine through a transmission having identical gear ratios effective thereby to cause each propeller to have the same rotational velocity when in operation.

10. A boat as in claim 6 further characterised in that the means controlling the propulsion driving direction of each propeller includes a gear member the rotational position of which controls the propulsion direction of the propeller, an electric motor coupled to the said gear member and adapted to effect rotational drive of this in either of two rotational directions dependent upon electrical signals received by the electrical motor, and control means coupled between the control member and the electric motor in respect of each propeller to effect a steering control thereby.

11. A boat propulsion drive means comprising a first shaft having a first spiral bevelled gear intermeshing with a second spiral bevelled gear situated on a second shaft, the second shaft aligned transversely to the first shaft, the second shaft having a third spiral bevelled gear facing in an opposite direction to the second bevelled gear and intermeshing with a fourth spiral bevelled gear disposed on a third shaft, the third shaft being positioned transverse to the second shaft and having a drive propeller positioned at one end opposite said fourth gear, the third spiral bevelled gear having its spiral in the same direction as the second spiral bevel gear, the second shaft being supported by a housing being rotatable 360° about the axis of said second shaft whereby the boat can be steered and propelled in the forward and reverse directions.

* * * * *